US008347561B2

(12) United States Patent
Howe

(10) Patent No.: US 8,347,561 B2
(45) Date of Patent: Jan. 8, 2013

(54) GEODESIC DOMES WITH REDUCED STRUT LENGTH VARIATIONS

(76) Inventor: Robert H. Howe, Lafayette, CA (US)

( * ) Notice: Subject to any disclaimer, the term of this patent is extended or adjusted under 35 U.S.C. 154(b) by 468 days.

(21) Appl. No.: 11/762,449

(22) Filed: Jun. 13, 2007

(65) Prior Publication Data

US 2008/0307720 A1 Dec. 18, 2008

(51) Int. Cl.
*E04B 7/08* (2006.01)
*E04H 12/00* (2006.01)
*F16D 1/00* (2006.01)

(52) U.S. Cl. ..... 52/81.3; 52/81.1; 52/81.2; 52/655.1; 52/DIG. 10; 403/169; 403/170; 403/171; 403/176

(58) Field of Classification Search ..... 52/81.1–81.6, 52/655.1, 655.2, DIG. 10; 403/169–171, 403/176

See application file for complete search history.

(56) References Cited

U.S. PATENT DOCUMENTS

| | | | | | |
|---|---|---|---|---|---|
| 2,682,235 | A | | 6/1954 | Fuller | |
| 3,145,441 | A | * | 8/1964 | Strandrud | 411/347 |
| 3,844,664 | A | | 10/1974 | Hogan | |
| 3,990,195 | A | * | 11/1976 | Gunther | 52/81.3 |
| 4,097,043 | A | * | 6/1978 | Rudy | 482/35 |
| 4,187,613 | A | * | 2/1980 | Ivers et al. | 33/32.1 |
| 4,194,851 | A | * | 3/1980 | Littlefield | 403/218 |
| 4,498,800 | A | * | 2/1985 | Sielaff | 403/172 |
| 4,511,278 | A | * | 4/1985 | Robinson | 403/172 |
| 4,703,594 | A | | 11/1987 | Reber | |
| 4,844,649 | A | * | 7/1989 | Vandenboom | 403/172 |
| 5,230,196 | A | | 7/1993 | Zeigler | |
| 5,437,515 | A | * | 8/1995 | Kuramoto et al. | 403/154 |
| 5,797,695 | A | * | 8/1998 | Prusmack | 403/170 |
| 5,996,288 | A | | 12/1999 | Aiken | |
| 6,296,415 | B1 | | 10/2001 | Johnson et al. | |
| 2004/0158999 | A1 | | 8/2004 | Trantow | |

* cited by examiner

*Primary Examiner* — Brian Glessner
*Assistant Examiner* — Omar Hijaz
(74) *Attorney, Agent, or Firm* — David Pressman

(57) ABSTRACT

A domed structure (500) comprises a plurality of struts (505) of equal or a reduced number of differing lengths. The struts are held in place by hubs (510, 515, 1400). In one aspect, a first hub secures the ends of inserted struts at a constant distance from its center, while other hubs secure the ends of inserted struts at predetermined distances from their centers. The differences between the various predetermined distances is the difference in strut lengths required by the design of the structure. Thus all struts are of equal length and identical, or a reduced number of lengths, resulting in an economy of scale and ease of construction. A cover can be added after the structure is built. Alternatively, the hubs can be sewn into a fabric or plastic cover for further ease of construction. The struts can be glued in place, or removed from the hubs to disassemble the structure.

20 Claims, 6 Drawing Sheets

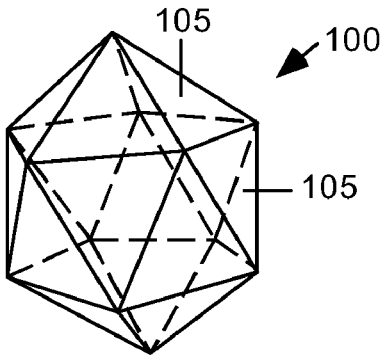
Fig. 1--Prior Art
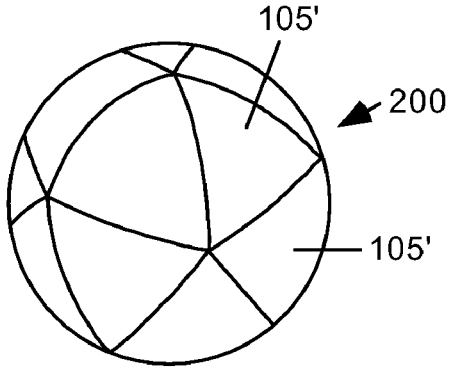
Fig. 2--Prior Art
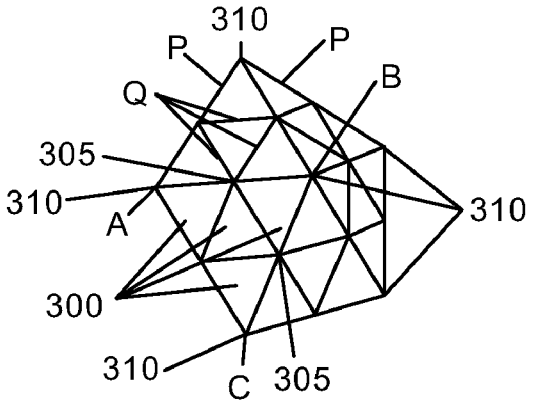
Fig. 3--Prior Art
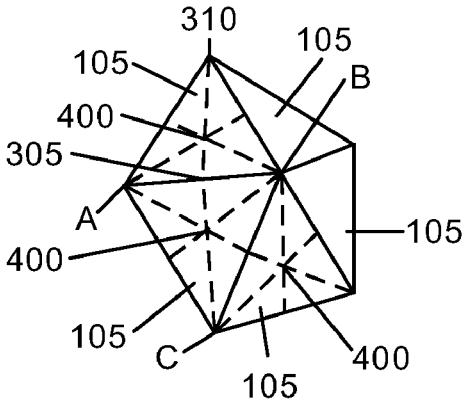
Fig. 4--Prior Art

GEODESIC DOMES WITH REDUCED STRUT LENGTH VARIATIONS

CROSS-REFERENCE TO RELATED APPLICATIONS

None

BACKGROUND

1. Field of Invention

The field is structural members for use in building construction, and in particular geodesic domes and strut attachment hubs for use in such domes.

2. Prior Art

The term "geodesic" means the shortest line between two points on any geometrically defined surface, and a geodesic structure is one made of structural elements that are held in place by a collection of hubs. I.e., the ends of such structural elements are attached by strut attachment hubs; the entire arrangement usually forms a geodesic dome.

In U.S. Pat. No. 3,844,664 (1974), Hogan shows a disc-like hub for an icosahedron (20-sided) structure. The attachment points for Hogan's struts are all equidistant from the center of the hub.

In U.S. Pat. No. 4,534,672 (1985), Christian shows a hub for a geodesic dome with wooden struts. The hub has six connection points, each comprising a pair of metal straps that sandwich the end of a strut. The six pair of straps are joined to each other at their inner ends. The straps each have a hole for holding a bolt that is inserted through the straps and the strut. The straps are arranged to accommodate struts of three different lengths, A, B, and C.

Reber, in U.S. Pat. No. 4,703,594 (1987), shows a hub with radially equidistant connection points; therefore struts of differing lengths are required by his design.

Ziegler, in U.S. Pat. No. 5,230,196 (1993), shows a polyhedron construction system with a hub for connecting cables and struts.

In U.S. Pat. No. 5,996,288 (1999), Aiken shows a geodesic dome with a hub for wood struts having connection points equally spaced from the center.

In U.S. Pat. No. 6,296,415 (2001), Johnson et al. show a hub for holding the struts of a structure where the ends of the struts are ball-shaped. The hub has sockets for holding the ball-ends. The distance between the ends of the balls of coaxially-aligned struts can be adjusted to accommodate different fabrics laid over the struts by rotating the hub.

In published U.S. patent application 2004/0158999, Trantow shows struts for geometric modeling with end connectors.

The prior-art hubs described above all provide structural integrity in structures constructed of struts. In the case of geodesic domes, struts of differing lengths have previously been fitted to hubs at a series of connection points, each of which is located at the same distance from the center of the hub.

3. Prior-Art—Geodesic Structures—FIGS. 1 through 3

Geodesic domes are well known in the art. The underlying principle in the construction of such domes is the subdivision of spherical surfaces into triangles or other geometric figures. This is usually done by projecting the sides of a polyhedron (multiple-sided figure) onto the surface of a sphere circumscribed about the apexes of the polyhedron. The polyhedron usually is usually one of the five Platonic solids, namely a convex, regular polyhedron with four, six, eight, twelve, or twenty sides, i.e., a tetrahedron, a cube, an octahedron, a dodecahedron, or an icosahedron. This can be achieved by several methods with varying results. In general, the strongest structures are made using a polyhedron with equilateral triangular sides. Thus the cube and dodecahedron, which don't have equilateral triangular sides, are less important in structural design than the three remaining Platonic solids.

As stated, all of the apexes of the polyhedron lie on the surface of a circumscribed sphere. When the edges of the tetrahedron, octahedron, or icosahedron are projected onto the surface of the sphere they define great circle arcs. Careful examination reveals that any further subdivisions and projection of these solids (which, as stated, have equilateral triangular sides) onto a sphere creates isosceles triangles (two equal-length sides) and not the desired equilateral triangles (three equal-length sides). This can more readily be understood by examining a group of equilateral triangles, each sharing an edge with the next and clustered about a single point. Three equilateral triangles clustered thusly form a tetrahedron. Four clustered thusly form one half of an octahedron. Five form one portion of an icosahedron, but when six are arrayed in this manner they are planar, and when projected onto the surface of a sphere it becomes clear that some of the edges must elongate before they can conform to the spherical curvature. I.e., the projected edges of the solid with equilateral triangular sides have differing lengths on the sphere.

However it is desirable for the lengths of the projected geodesic edges to be as equal as possible. There are two reasons for this. First is the matter of structural efficiency: if the same cross section is used for all elements, that cross section must be sufficient for the strength of the longest of those elements and therefore more substantial than required for the shorter elements. This leads to an over building of some components and a consequent inefficiency of material utilization.

The second reason for uniformity of edge lengths is important is for simplification of construction. This is especially true in portable structures that must be assembled and disassembled frequently. It becomes even more important when those who are to assemble the domes are not trained specifically in their construction. Military tents are frequently set up by untrained infantry personnel, and emergency relief tents are frequently set up by the very civilians who must use them for shelter. Thus it can be seen that it is highly desirable to reduce the complexity of this type of geodesic dome.

In U.S. Pat. No. 2,682,235 (1954), Fuller shows the construction of a geodesic dome. Struts of differing lengths are used in the assembly of the dome.

FIG. 1 of the drawings shows a prior-art icosahedron 100. As described in the Fuller patent, supra, icosahedron 100 is a starting polyhedron having 20-sides with 20 equilateral triangles 105, with twelve vertices, and 30 sides. He then "explodes" this figure within an imaginary sphere 200 (FIG. 2), thereby projecting the sides of triangles 105 onto sphere 200, yielding a number of curvilinear triangles 105'. The curved sides of triangles 105' lie on great circles on sphere 200. Fuller's method for subdividing icosahedron 100 into triangles is referred to as the "Alternate Method" by those skilled in the art of geodesic structure design. There are other methods, including the Triacon Method, discussed infra.

FIG. 3 shows a portion of Fuller's icosahedron 100 of FIG. 1. The lines forming equilateral triangles 300 intersect at points 310. The intersections of lines A-B-C forming triangles 300 contain five lines.

In his structure, Fuller refers to the lines forming the triangles as struts. He approximates sphere 200 (FIG. 2) with a large number of struts that are joined at their vertices by hubs.

The nearer the structure comprising struts and hubs approximates a sphere, the stronger the structure will be.

In Fuller's structure, each of triangles 105 is subdivided further, or tessellated, into smaller triangles 300 (FIG. 3). For example, triangle A-B-C is subdivided into four triangles 300. The lines forming triangles 300 and 105 intersect at points 305. Each of these intersections contains six lines. The term frequency is used to indicate the degree of tessellation of the original, icosahedral triangle 105. A frequency of four is shown in FIG. 3, meaning that the original triangle is divided into four smaller triangles. Additional tessellations can be performed, yielding many more triangles. Fuller notes that with a frequency of four, five different strut lengths are required to build a dome. A frequency of eight requires 16 different strut lengths, while a frequency of 16 requires 56 different strut lengths.

The Triacon Method

FIG. 4 illustrates the Triacon Method for dividing triangles 105, so called due to its relationship to the rhombic (equilateral parallelogram) triacontahedron (polyhedron with 30 faces). Instead of subdividing each triangle 105 into a series of smaller triangles 300 (FIG. 3), a new point 400 is identified at the center of each of triangles 105. Point 400 is located at the intersection of three lines within each of triangles 105. These lines are drawn from the vertex at A to the midpoint of side BC, the vertex at B to the midpoint of side AC, and the vertex at C to the midpoint of the side AB. This is done for each of triangles 105. A structure can be made using struts that join a number of points 400 within an icosahedron 100 (FIG. 1). Such a structure is similar to Fuller's geodesic dome, but is simpler to construct.

A two-frequency structure designed using the Triacon Method requires fewer struts than its Alternate Method equivalent. Using either method, two different strut lengths are required to form a small structure such as a tent for use in camping. In the Triacon Method, the difference in strut lengths is about 13 percent. This increases the cost of the structure since several sets of struts, each having different lengths, must be provided. In addition, the assembly of a structure with different-length struts is relatively complex, especially when untrained workers perform the assembly.

Thus prior-art geodesic structures require struts of at least two and possibly more than 56 different lengths. This is undesirable because, as stated, it creates increased cost, structural inefficiency, and complexity of construction.

SUMMARY

In accordance with an aspect of one embodiment, a geodesic dome comprises struts and interconnecting hubs, where the hubs include strut end connection points at more than one radial distance from the center of the hubs. The difference in such radial distances compensates for the prior-art difference in lengths required for struts at various points in the structure. Thus a geodesic dome can be constructed from struts that are all of the same length. The resulting structure is easier to build and lower in cost than the prior-art versions.

DRAWING FIGURES

FIG. 1 shows a prior-art icosahedron comprising twelve equilateral triangles.

FIG. 2 shows the icosahedron of FIG. 1 projected onto the surface of a sphere.

FIG. 3 shows the division of the triangles comprising icosahedron of FIG. 1 into a collection of smaller triangles.

FIG. 4 shows the division of the triangles of FIG. 1 using the Triacon Method.

Figure 14:
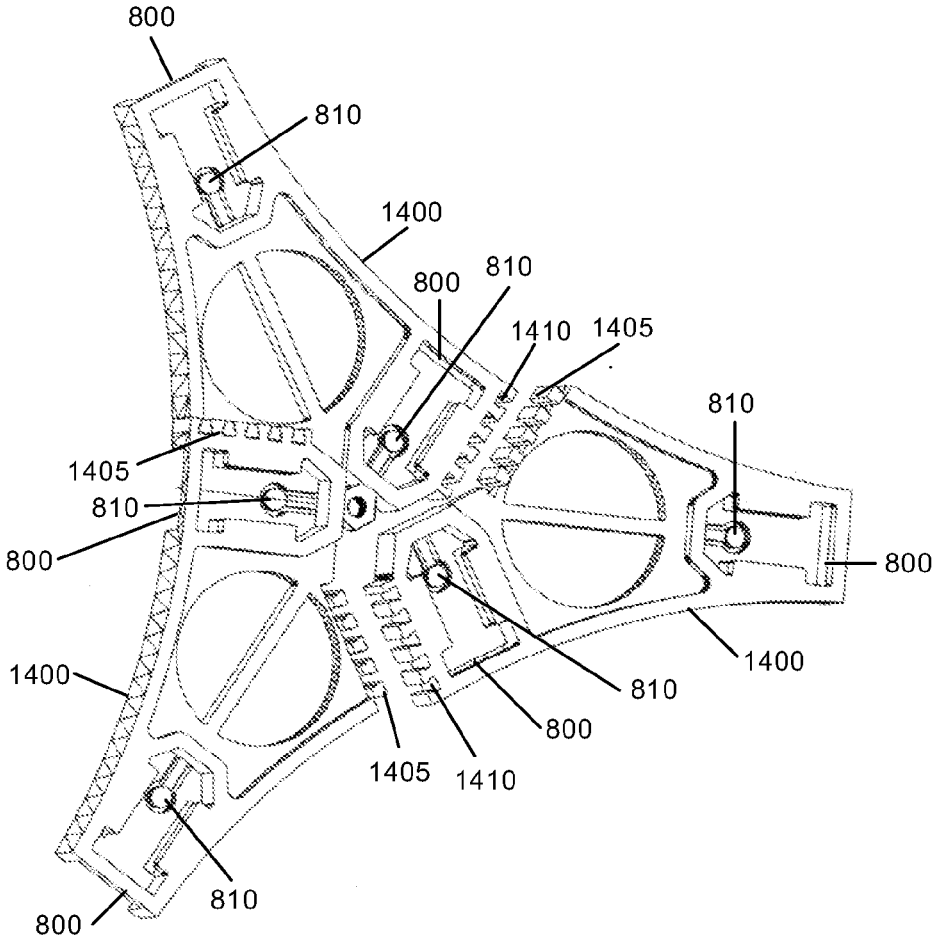
Figure 14A:
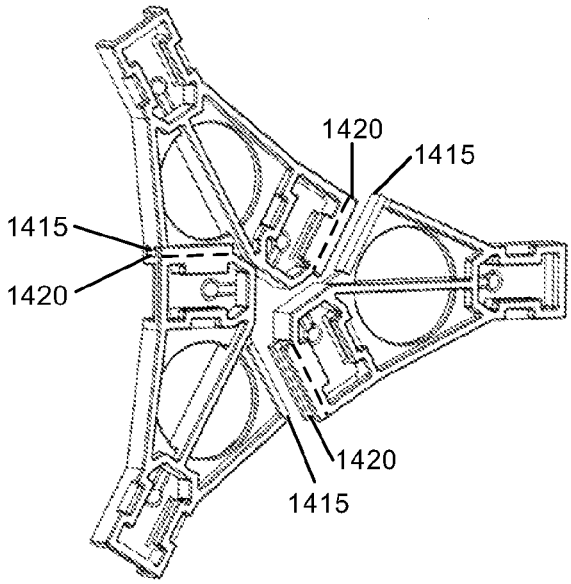
Figure 15:
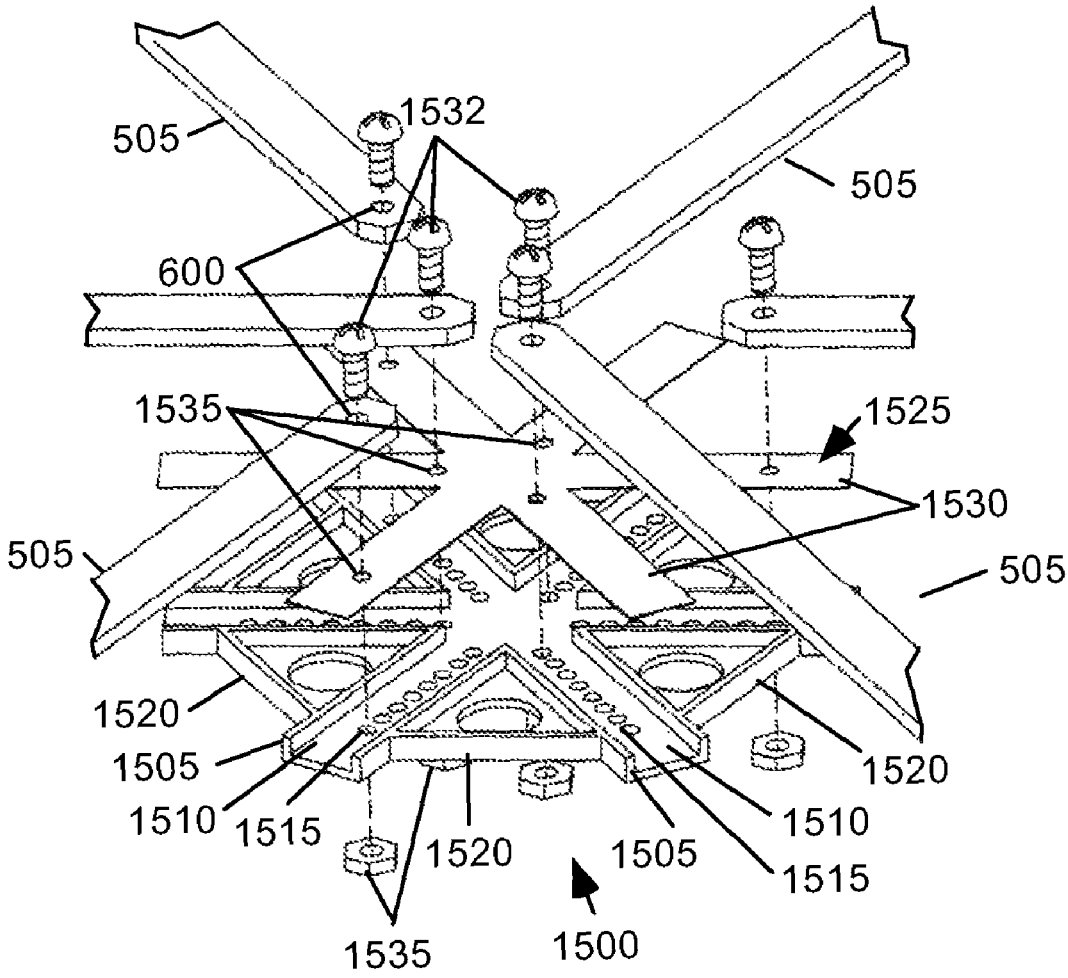

FIGS. 14, 14A, and 15 show alternative hub designs.

REFERENCE NUMERALS

| | |
|---|---|
| 100 | Icosahedron |
| 105 | Triangle |
| 200 | Sphere |
| 300 | Triangle |
| 305 | Point |
| 310 | Point |
| 400 | Point |
| 500 | Structure |
| 505 | Strut |
| 510 | Hub |
| 515 | Hub |
| 520 | Entrance |
| 521 | Entrance |
| 525 | Hanger |
| 530 | Fastener |
| 531 | Frame |
| 532 | Material |
| 535 | Floor |
| 540 | Attachment |
| 600 | Hole |
| 800 | Slot |
| 802 | Stop |
| 805 | Guide |
| 810 | Finger |
| 1000 | Hole |
| 1101 | Cover |
| 1105 | Screw |
| 1110 | Washer |
| 1300 | Washer |
| 1305 | Nut |
| 1400 | Hub section |
| 1405 | Teeth |
| 1410 | Teeth |
| 1416 | Hub section |
| 1415 | Tongue |
| 1420 | Slot |
| 1500 | Hub |
| 1505 | Arm |
| 1510 | Channel |
| 1515 | Hole |
| 1520 | Webbing |
| 1525 | Template |
| 1530 | Arm |
| 1532 | Screw |
| 1535 | Nut |

FIRST EMBODIMENT

Hubs for Use with Struts of Equal Length—Description—FIGS. 5-13

Figure 5:
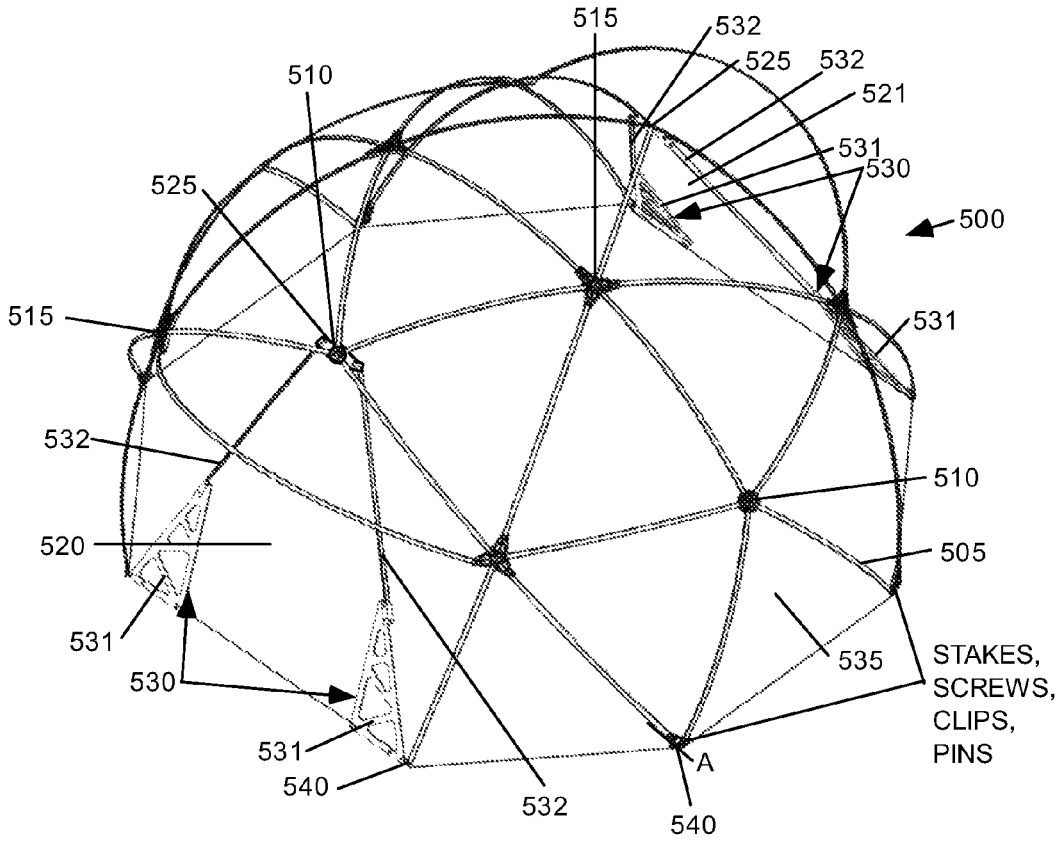
FIG. 5 shows a structure according to one aspect of a first embodiment.

FIG. 5 shows a tent frame structure 500 made according to an aspect of one embodiment. In the past structure 500 would have used struts of two different lengths but, due to the use of special hubs, the structure can be constructed with all struts of equal lengths.

Structure 500 comprises 39 identical struts 505, two different types of hubs 510 and 515, two hangers 525, a number of ground attachment points 540, four portal fasteners 530, each comprising a triangular frame 531 and a short length of strut material 532, and an optional floor 535. Struts 505 are joined at the vertices of structure 500 by hubs 510 and 515. An open entrance or portal 520 is formed using two additional struts 505 anchored at the top and bottom of entrance 520 by a hanger 525 and fasteners 530, respectively. Hanger 525 is suspended from one of hubs 510 by a piece of sturdy material (not shown) such as wire, plastic, or even twine. Alternatively, hanger 525 can be secured to hub 510 by a bolt or screw (not shown).

Structure 500 has four each of hubs 510 and 515 and two each of hangers 525. A larger structure can include more hubs with same-length struts, longer struts and fewer hubs, or a combination.

Floor 535 completes structure 500. All of the lower struts 505 are fastened to floor 505 at attachment points 540 using stakes, screws, clips, or pins. Struts 505 are initially straight and made of a flexible material. When they are in use, they are springably bent into a curved shape. When structure 500 is assembled, struts 505 hold floor 535 in tension by virtue of being restrained at its edges. Floor 535 is therefore flat and structure 500 is self-supporting.

Figure 6:
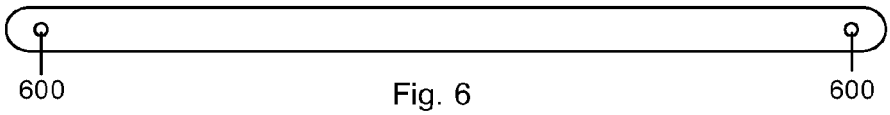
FIGS. 6 and 7 are top and side views of struts.
Figure 7:
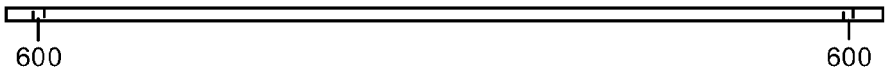

FIGS. 6 and 7 show top and side views of one of struts 505. In one embodiment of a 200 cm high dome, struts 505 are typically 2 cm wide, 0.5 cm thick, and 1.3 m long, although different sizes can be used. A hole 600 with a 3 mm diameter is located about 0.5 cm from each end. In one aspect, struts 505 are made of an epoxy-fiberglass or other composite material, although they can also be metal or wood.

Figure 8:
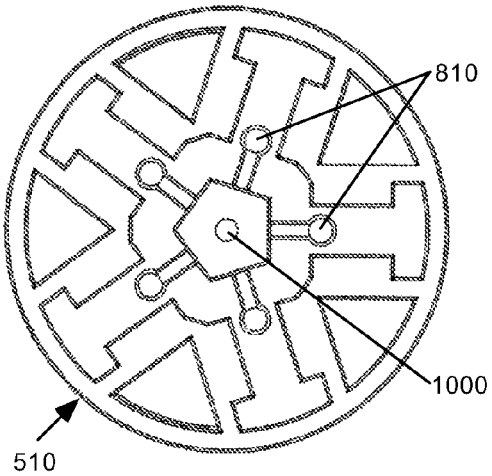
FIGS. 8 through 10 show a first hub design.
Figure 9:
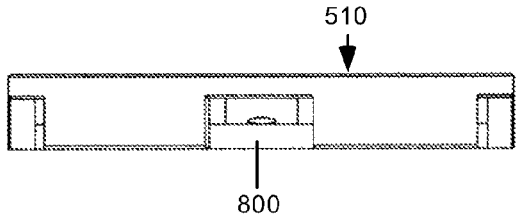
Figure 10:
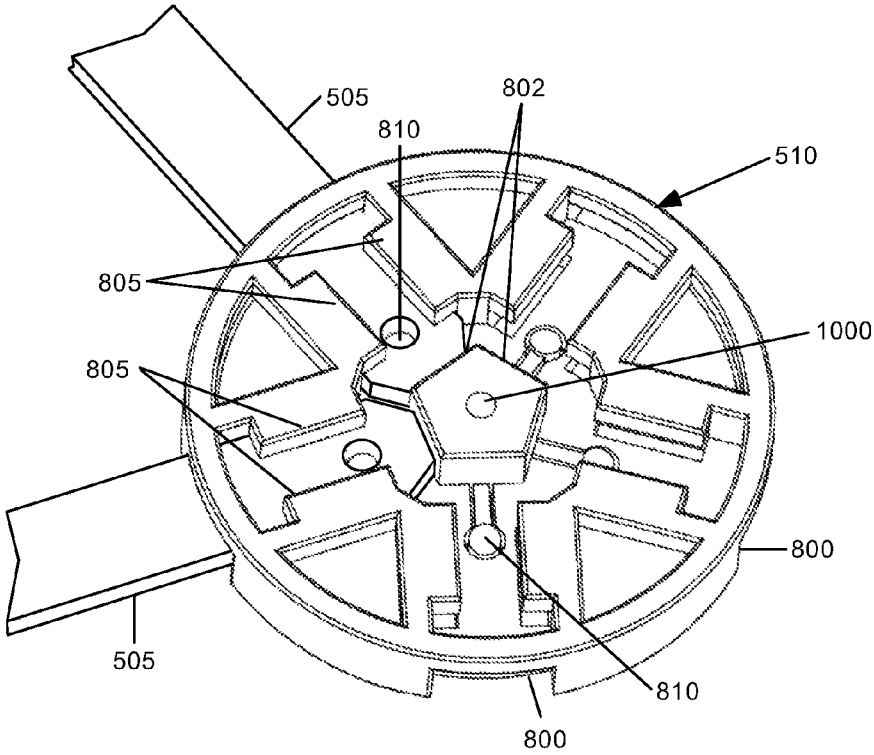

FIGS. 8 and 9 respectively show bottom and side views of one of hubs 510. FIG. 10 is a top perspective view of a hub 510 with two struts 505 installed. Hub 510 comprises a series of five connection points or connectors for the ends of struts 505, consisting of slots 800 with optional guides 805 and springably mounted fingers or locking buttons 810. Fingers 810 are sized to slidably fit into holes 600 in struts 505. The ends of fingers 810 may also be tapered for ease of displacement by the ends of struts 505, thereby easing entry of fingers 810 into holes 600. The ends of struts 505 are inserted into slots 800 and urged inward until they encounter one of five terminal stops 802. When strut 505 is fully inserted, finger 810 springably enters hole 600 (FIG. 6), thereby holding strut 505 captive within hub 510. All five struts are held or connected to hub 510 so that their ends are positioned at equal spacings from the center of hub 510. Strut 505 can be released from hub 510 by pressing on finger 810 through hole 600. Finger 810 can also be removed from hole 600 by lifting finger 810 from the opposite side of hub 510. Hub 510 holds five equal-length struts and stops 802 and fingers 810 are radially equidistant from center 1000.

Figure 11:
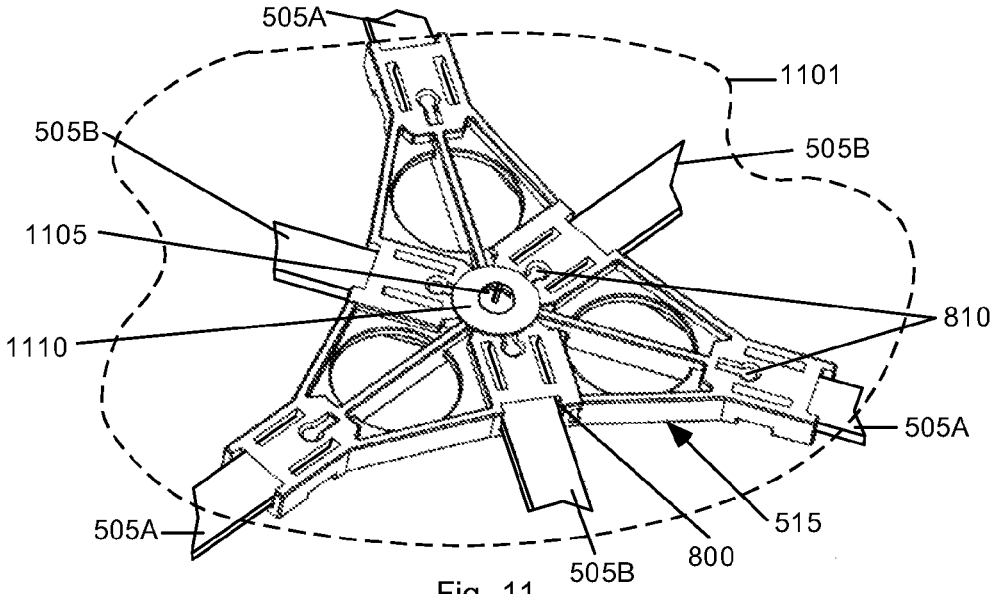
FIGS. 11 through 13 show a second hub design.
Figure 12:
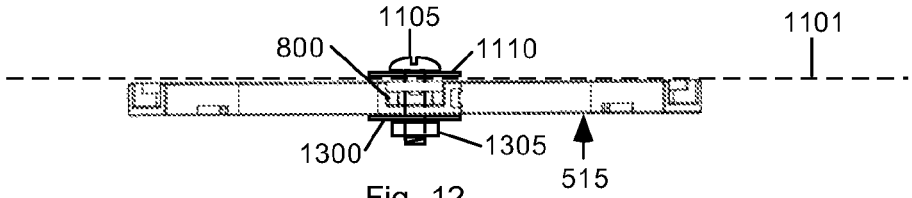
Figure 13:
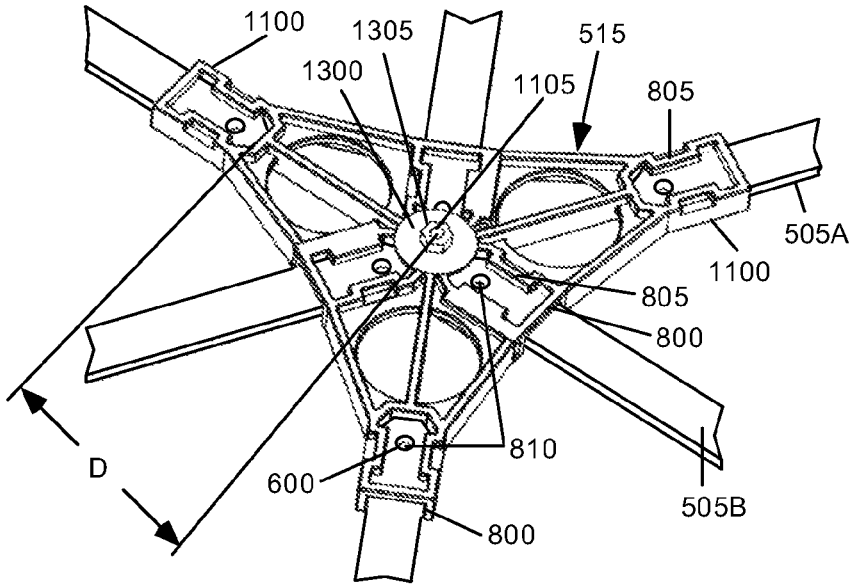

FIGS. 11-13 respectively show bottom, side, and top perspective views of one of hubs 515. Hubs 515 also include connection points or connectors for struts 505. Such connection points or connectors consist of slots 800 and optional guides 805 (FIG. 13), and fingers 810 for guiding and holding struts 505 in place. Hubs 515 accommodate up to six struts 505. FIG. 13 shows hub 515 with six of struts 505 installed. Three of struts 505 terminate or have their ends at or very near the center of hub 515. The remaining three, in alternate positions, terminate or have their ends at a spacing D from the center of hub 515. Since hubs 515 have connection points or connectors at two different radial spacings from the hub centers they can be called special hubs.

In the prior-art version of structure 500 (FIG. 5), which resembles the structure described above made by the Triacon Method (triacontal structure), two different strut lengths were required, with the difference in length being approximately 13 percent of the length of the strut.

In hub 515 (FIG. 13), as shown, the strut connection points are spaced at two different radial distances from the hub's center to enable all struts connected to the hub to be identical in length. Spacing D, from the center of the hub to the inner end of struts 505A, is approximately equal to 6.5 percent of the length of struts 505. Thus if strut 505 is 1.3 meters in length, spacing D will be 8.45 cm. In this case, arms 1100 of hub 515 extend radially so that the ends of struts 505A engaged by arms 1100 are 8.45 cm farther from the center of hub 515 than struts 505B. Thus, as shown, the connection points for struts 505B are radially spaced closer to the hub's center than the connection points for struts 505A. This enables all struts 505A and 505B to be identical in length and indistinguishable, except that their ends terminate at two different spacings from the center of hub 515. The hub sizes scale according to the distance D and the width and thickness of struts 505.

Hub 515 holds six struts, while hub 510 holds 5 struts. This is a consequence of the both the triangular and the Triacon divisions of icosahedron 100 (FIG. 1).

The skeleton of tent or structure 500 (FIG. 5) comprises 35 struts 505 of equal length, two hangers 525, four fasteners 530, five hubs 515, four hubs 510, and a floor piece 535. A plastic or fabric cover 1101 (shown partially in FIG. 11) completes tent 500.

Hubs 510, 515, and 525 can be sewn into cover 1101, if desired. Otherwise, the hubs can be provided separately. FIG. 11 shows a portion of cover 1101 attached to hub 515 by a screw 1105, two washers 1110 and 1300 (FIG. 13), and a nut 1305. Cover 1101 has a number of holes (not shown) that are strategically located so that hubs 515, and any other required hubs, are secured at the correct locations. Washers 1110 and 1300 reduce stress on cover 1101 when screw 1105 and nut 1305 are tightened, thereby reducing the likelihood that cover 1101 will tear. The hubs can be made of plastic, metal, fiberglass composite, or wood.

The above discussion describes hubs that compensate for designs that anticipate two different strut lengths. In a prior-art structure with a higher-frequency Geodesic subdivision, the number of different anticipated strut lengths will usually be greater than two. In practice, hubs can be made to compensate for any number of anticipated strut lengths.

In some Geodesic designs that anticipate more than one strut length, many different hubs may be required. Alternatively, the use of struts of more than one length can be traded against the use of hubs of more than one design. In other designs, not all slots in a hub are occupied with a strut, but can be vacant instead.

FIRST EMBODIMENT

Hubs for Use with Struts of Equal Length—Operation—FIG. 5

To assemble the dome of FIG. 5, the user first lays floor 535 flat on a horizontal surface, such as the ground. Two struts 505 are attached to each of hangers 525 and fasteners 530. Fasteners 530 are attached to floor 535 at attachment points 540. Each of hangers 525 is attached to one of hubs 510. The remaining struts 505 are inserted in hubs 510 and 515 and fastened to floor 535 at points 540.

If tent 500 has a cover that incorporates hubs 510 and 515, the placement of the hubs is predetermined by the tent manufacturer and insertion and fastening of struts 505 is a straightforward matter. Otherwise hubs 510 and 515 can be secured to cover 1101 (FIG. 11) by screws 1105, washers 1110 and 1300, and nuts 1305. If tent 500 is a skeletal frame, then a diagram must be followed to properly locate hubs 510 and 515. In either case, construction of the tent is straightforward since only the location of the hubs is of concern, and selecting among struts of differing lengths is not required.

Instead of being attached to bottom 535, attachment points 540 can take the form of stakes driven in the ground at predetermined locations. In this case, floor 535 is not required.

Thus by providing hubs that each have connection points with different radial spacings, the hubs will enable all equal-length struts (or struts with fewer different lengths) to be used to connect the hubs, despite a plurality of different hub-to-hub distances. I.e., by employing hubs with connection points with different radial spacings a geodesic dome can be constructed with all struts of equal length (or with fewer lengths), even though the dome has a plurality of different distances between adjacent hubs that would otherwise require virtual or anticipated struts of two or more different lengths.

FIRST ALTERNATIVE EMBODIMENT

Description and Operation—Sectional Hub—FIGS. 14 and 14A

FIG. 14 shows a hub comprising a plurality of separate sections 1400. All three sections of hub 1400 are assembled to form one of hubs 515. At some locations in a domed structure, fewer than six struts intersect. At these locations, only one or two of sections 1400 may be required, depending on the angles between the converging struts. For example, the hub at point 540 marked A (FIG. 5) holds only two struts. Thus only one of sections 1400 is required at this location.

Each section 1400 includes two connection points consisting of slots 800 with optional fingers 810 for locking struts (not shown) in place, as described above in connection with FIGS. 11-13. Sections 1400 lock together with mating teeth 1405 and 1410.

FIG. 14A shows a hub design comprising sections 1416, each with elongated interlocking components 1415 and 1420. To assemble, a tongue 1415 is inserted into a slot 1400. Tongue 1415 and slot 1420 are sized so that they are held together by friction. Alternatively, they can be glued, or designed to snap together.

SECOND ALTERNATIVE EMBODIMENT

Description and Operation—Universal Hub—FIG. 15

FIG. 15 shows a hub 1500 having six radial arms 1505. Hub 1500 is used instead of hubs that have fixed arm lengths. Each of arms 1505 has an open channel 1510 with a number of holes 1515 in a radial line at the center of the channel. The number of holes 1515 in each channel can be between 1 and 10 or more. A web 1520 joins neighboring arms 1505 to provide strength. Each of holes 1515 is a potential connection point for a strut 505.

An optional guide or template 1525 has radial arms 1530 that slidably fit into channels 1510 of hub 1500. Arms 1530 further include a hole 1535 for guidance in placement of the ends of struts 505 and selection of the proper connection point for a strut 505. Template 1525 can be secured to arms 1530 by an adhesive, if desired.

In use, template 1525 is slidably inserted into channels 1510 in hub 1500. One of holes 1535 in template 1525 is aligned with one of holes 1515 in hub 1500. The distance of each hole in template 1525 from the center of hub 1500 is determined by the design of the geodesic structure (not shown) being built.

During assembly of the structure, a hole 600 in each strut 505 is aligned with hole 1535 in template 1525 and one of holes 1515 in arm 1505 of hub 1500. A screw 1532 is inserted into hole 600 of strut 505, passed through hole 1535 of template 1525 and the mating hole 1515 in arm 1505, then secured by a nut 1535. Thus holes at various predetermined locations in template 1525 determine the compensating length of each strut position, thereby permitting various geodesic structures to be made from struts all of one length.

Hub 1500 can have two or more arms 1505 positioned at any desired, predetermined angle. Hub 1500 can be made of plastic, a composite material, metal, or wood. Struts 505 have approximately the same width as those described above. Hub 1500 and template 1525 scale accordingly. Screws 1532 and nuts 1535 are typically U.S. National fine thread standard size 8-32, although another size can be used. In lieu of a screw, a rivet, pin, or other fastener can be used. Template 1525 is made of plastic, metal, wood, or a composite material and is approximately 0.8 mm thick, although other thicknesses can be used.

In an alternative aspect, some geodesic designs efficiently use two or more strut lengths. With its numerous hole positions, hub 1500 can accommodate struts of more than one length, if desired.

SUMMARY, RAMIFICATIONS, AND SCOPE

The embodiments shown greatly simplify erection of a domed structure. All struts used in the structure are identical. Thus the structure is easier to construct and less expensive than previous designs. Some structure designs require only two hub designs. Others that anticipate using struts of many lengths will require hubs of more than two designs. Each of the hubs includes extensions that replace the additional length of strut anticipated in the structure. In one aspect, a universal hub accommodates a wide variety of anticipated or virtual strut lengths.

While the above description contains many specificities, these should not be considered limiting but merely exemplary. Many variations and ramifications are possible.

Instead of a tent, a larger structure such as a shelter or a smaller structure such as a pet house can be built. Instead of a plastic or fabric cover, a metal cover can be secured to the skeleton. Instead of doorways, the structure can be entered through the floor. Instead of springable fingers that allow removal of struts and disassembly of the structure, glue can be used to permanently cement the struts in the hubs. Instead of rectangular in cross-section, the struts and the slots into which they are installed can be square, oval, hexagonal, diamond-shaped, star-shaped, or round. Instead of equal angles between the slots in the hubs, one or more slots can be oriented at a different angle in the same plane. Instead of all slots lying in the same plane, one or more slots can be oriented at an angle to the plane of the hub. Instead of all slots being filled with struts, one or more slots can be vacant.

While the present system employs elements which are well known to those skilled in the art of structural dome design, it combines these elements in a novel way which produces one or more new results not heretofore discovered. Accordingly the scope of this invention should be determined, not by the embodiments illustrated, but by the appended claims and their legal equivalents.

The invention claimed is:

1. A geodesic structure, comprising a plurality of struts, a plurality of hubs interconnecting said struts to form a geodesic dome, said geodesic dome having a plurality of different distances between adjacent hubs, said plurality of struts having equal lengths, each strut being an elongated member having two opposite ends, said hubs each having a center and a plurality of strut connectors thereon, each strut connector spaced out from said center by a predetermined radial spacing, at least some of said hubs, called special hubs, having their plurality of strut connectors positioned at different radial spacings from the center of each special hub, the ends of said plurality of struts being attached to a corresponding plurality of said strut connectors on each of said hubs, the ends of said plurality of struts that are connected to said special hubs being positioned at different radial spacings from the centers of said hubs, whereby said struts have equal lengths even though said geodesic dome has a plurality of different distances between adjacent hubs.

2. The geodesic structure of claim 1 wherein each of said strut connectors comprises a slot for accepting a strut end, each of said strut ends further including a hole, and said slot further including finger or button means springably insertable into said hole for retaining a strut end in said hub.

3. The geodesic structure of claim 2 wherein said finger or button means is arranged to be springably dislodgeable from said hole, thereby enabling said strut to be released from said hub easily.

4. The geodesic structure of claim 1 wherein said geodesic structure is a dome.

5. The geodesic structure of claim 1, further including a floor attached to said structure.

6. The geodesic structure of claim 1 wherein each of said struts further includes a hole at each of said ends thereof and each of said strut connectors includes a plurality of slots, each slot further including a guide and a springable finger, whereby when the end of one of said struts is inserted into one of said slots, said springable finger is arranged to enter said hole, thereby retaining said strut in said hub.

7. The geodesic structure of claim 6 wherein said finger is arranged to be springably dislodgable from said hole, thereby enabling said strut to be released from said hub easily.

8. The geodesic structure of claim 1 wherein at least some of said hubs each have their connection points or strut connectors at the same radial spacings from said center and the struts attached to said hubs each have their ends positioned with equal spacings from said center, the rest of said hubs being said special hubs which have their connection points or strut connectors at the different radial spacings from said center and the struts attached to said special hubs each have their ends positioned at different radial spacings from said center.

9. A geodesic structure, comprising a plurality of struts and a plurality of hubs interconnecting said struts to form a geodesic structure, said geodesic structure having a plurality of different distances between adjacent hubs, each of said struts comprising an elongated member having a pair of opposite ends, said pair of ends of each strut being attached to a pair of said hubs, respectively, each of said hubs comprising a center and a plurality of strut connectors attached thereto, the ends of said struts attached to at least some of said hubs being spaced unequally from the center of each of said hubs, at least some of said hubs, called special hubs, having their plurality of strut connectors positioned at different radial spacings from the center of each special hub, the ends of said plurality of struts being attached to a corresponding plurality of said strut connectors on each of said hubs, whereby said struts have equal lengths even though said geodesic dome has a plurality of different distances between adjacent hubs.

10. The geodesic structure of claim 9 wherein each of said strut connectors further includes a slot for accepting the end of a respective strut end, each of said strut ends further including a hole, and each of said slots further include finger or button means springably insertable into said hole for retaining said strut end in said hub.

11. The geodesic structure of claim 10 wherein said finger or button means is arranged to be springably dislodgeable from said hole, thereby enabling said strut to be released from said hub easily.

12. The geodesic structure of claim 9 wherein said geodesic structure is a dome.

13. The geodesic structure of claim 12 wherein said dome includes a floor under said dome.

14. The geodesic structure of claim 9 wherein each of said struts further includes a hole at each of said ends thereof and each of said strut connectors includes a slot, each slot further including a guide and a springable finger, whereby when the end of one of said struts is inserted into one of said slots, said springable finger is arranged to enter said hole, thereby retaining said strut in said hub.

15. The method of claim 14 wherein said finger is arranged to be springably dislodgable from said hole, thereby enabling said strut to be released from said hub easily.

16. The geodesic structure of claim 9 wherein at least some of said hubs each have their connection points or strut connectors at the same radial spacings from said center and the struts attached to said hubs each have their ends positioned with equal radial spacings from said center, the rest of said hubs being special hubs which have their connection points or strut connectors at different radial spacings from said center and the struts attached to said special hubs each have their ends positioned at different radial spacings from said center.

17. The geodesic structure of claim 9 wherein each of said hubs includes a plurality of channels for receiving respective struts, each channel having a plurality of holes with different radial spacings, each of said struts has a hole therein for mating with a respective one of said holes in a respective channel, whereby each of said struts can be connected to a hub so that its end can be positioned at any of a plurality of radial spacings on said hub.

18. A method for constructing a geodesic dome structure, comprising:

providing a plurality of interconnecting struts, said plurality of struts having equal lengths, providing a plurality of hubs arranged to interconnect said struts to form a geodesic dome, said geodesic dome having a plurality of different distances between adjacent hubs, said hubs each having a center and a plurality of strut connection points or strut connectors, each strut connection point or strut connector spaced out from said center at a predetermined radial spacing, at least some of said hubs, called special hubs, having their plurality of strut connectors spaced at different radial spacings from the center of said special hub, attaching the ends of said plurality of said struts to a corresponding plurality of said strut connectors on each of said hubs, the ends of said plurality of struts that are connected to said special hubs being positioned at different radial spacings from the center of each of said special hubs, assembling said geodesic dome structure using said struts and said plurality of hubs such that each hub has a plurality of struts connected to said hub, and said plurality of struts are connected between different hubs, whereby said struts have equal lengths even though said geodesic dome has a plurality of different distances between adjacent hubs.

19. The method of claim 18 wherein each of said struts further includes a hole at each end and each of said strut connectors includes a slot, each slot further including a guide and a springable finger, whereby when the end of one of said struts is inserted into one of said slots, said springable finger is arranged to enter said hole, thereby retaining said strut in said hub.

20. The method of claim 1 wherein at least some of said hubs each have their connection points or strut connectors at the same radial spacings from said center and the struts attached to said hubs each have their ends positioned with equal spacings from said center, the rest of said hubs being said special hubs which have their connection points or strut connectors at different radial spacings from said center and the struts attached to said special hubs each have their ends positioned at different radial spacings from said center.

* * * * *